United States Patent [19]

Marino et al.

[11] 3,978,787

[45] Sept. 7, 1976

[54] DRIVE MEANS FOR CYLINDRICAL SCREEN PRINTER

[75] Inventors: Thomas Marino, Totowa Boro.; John Kreeft, Wyckoff; Peter Stanislaw, Stockholm, all of N.J.

[73] Assignee: Morrison Machine Co., Paterson, N.J.

[22] Filed: Oct. 11, 1973

[21] Appl. No.: 405,418

[52] U.S. Cl. ..... 101/115; 101/116; 101/178

[51] Int. Cl.[2] ..... B41F 15/10; B41F 5/14

[58] Field of Search ..... 101/115, 116, 118, 126, 101/127.1, 128.1, 178, 248, 181, 182

[56] References Cited

UNITED STATES PATENTS

| | | | |
|---|---|---|---|
| 2,809,581 | 10/1957 | Clem | 101/178 |
| 2,869,459 | 1/1959 | Bohme | 101/178 X |
| 3,456,584 | 7/1969 | Moskowitz | 101/115 X |
| 3,774,533 | 11/1973 | Ichinose | 101/119 |

FOREIGN PATENTS OR APPLICATIONS

| | | | |
|---|---|---|---|
| 2,046,467 | 1/1972 | Germany | 101/118 |
| 1,285,553 | 8/1972 | United Kingdom | 101/116 |

*Primary Examiner*—Edgar S. Burr
*Assistant Examiner*—R. E. Suter
*Attorney, Agent, or Firm*—Lerner, David, Littenberg & Samuel

[57] ABSTRACT

A screen printing machine is provided which includes a frame, a backing member supported by the frame, and at least one rotary screen assembly carried by the frame. Each rotary screen assembly includes an inner elongated support member, an outer hollow screen rotatably supported about the inner elongated support member for rotation thereabout, and an elongated applicator, which may be a conventional squeegee, which engages the inner surface of the hollow screen and which is supported by the inner elongated support member located within the screen. A first drive is provided which is operatively connected with the backing member for rotating the backing member. A second drive is provided for rotating the hollow screen independently of said first drive and the backing member. In addition, a variable speed device is provided in association with said second drive, for varying the speed of rotation of the rotatable screen relative to the speed of rotation of the backing member in order to synchronize the linear velocity of each of the rotatable screen and backing member.

4 Claims, 2 Drawing Figures

DRIVE MEANS FOR CYLINDRICAL SCREEN PRINTER

BACKGROUND OF THE INVENTION

Rotary screen printing machines are well known and typically include a frame, a backing means supported by the frame, and at least one, and usually a plurality, of rotary screen assemblies which are carried by the frame in close proximity with respect to the backing means. Typically, each rotary screen assembly includes an inner elongated support member, an outer hollow patterned screen supported about the inner elongated support member for rotation thereabout, and an elongated applicator, such as a conventional squeegee, which is supported on the inner elongated support member and engages the inner surface of the screen to press coloring paste or ink through the perforated pattern thereof as the fabric being printed is passed between the respective hollow screen and the backing means. In a rotary type screen printing machine, the backing means comprises a large drum and the plurality of rotary screen assemblies are supported circumferentially thereabout. In a flat bed screen printing machine, it is normal practice to provide the rotary screen assemblies in a common plane with each screen assembly being provided with a cooperating back-up roller associated therewith.

In the above-described types of machines, drive means are provided which drive the backing means (usually a large rotary drum) and the rotating screens of each assembly in response to rotation of the backing means. In order to effect such rotation, screen gear means are provided at one end of each of said rotary screen assemblies and a main gear, commonly referred to as a sun gear, is provided at one end of the backing means. The individual screen gears of the rotary screen assemblies engage the sun gear of the backing means so that upon rotation of the backing means and its sun gear, simultaneous rotation of said screen gears and said rotary screens connected thereto is effected. When the drive means is deactivated, this causes stoppage of the backing means and its associated sun gear and thus stoppage of rotation of said gear means and associated screens.

It is most important in the above-describe machines that the linear velocity of the rotatable screens be made to match the linear velocity of the backing means so that the printing will be accurately aligned on the fabric or other sheet material to be imprinted upon and the printed portion derived from one screen will be properly positioned with respect to the printed portion derived from another screen. Unfortunately, and contrary to normal expectation, it has been found that even where a direct linkage through the screen gears to the sun gear is employed, it is still not possible to accurately match the surface speeds of the screens and the backing means. Such failure is probably due to the variation in load on the screen when more or less pressure is applied to the squeegee as well as the variation in the viscosities of the inks or coloring pastes used.

SUMMARY OF THE INVENTION

In accordance with the present invention, there is provided a screen printing machine which includes means for substantially synchronizing or matching the linear velocities of the backing means and the screens of the rotary screen assemblies. The screen printing machine of the invention comprises a frame, backing means supported by the frame, at least one rotary screen assembly carried by said frame, said assembly including a rotatable screen, first drive means operatively connected to said backing means for rotating said backing means, second drive means operatively connected to said rotatable screen of said rotary screen assembly for rotating said screen independently of said backing means, and variable speed means, preferably in communication with said second drive means, for varying the speed of rotation of said rotatable screen relative to the speed of rotation of said backing means.

In essence, the screen printing machine of the invention makes use of the variable speed device for controlling the speed of the independently driven rotatable screen of said rotary screen assembly so that it can be made to substantially match the speed of the independently driven backing means.

In a preferred embodiment of the present invention, the backing means comprises a rotary drum and includes a shaft member having first and second end shaft portions for rotatably supporting said rotary drum on said frame. The first drive means for rotating said backing means independently of the screen of said rotary screen assembly includes motor means and a first linkage means interconnecting said motor means and said backing means. The second drive means for rotating the screens of the rotary screen assemblies comprises first or large gear means rotatably mounted on said first end shaft portion of said rotary drum in a manner such that it floats freely thereon and is rotatable independently of said rotary drum, motor means, drive gear means and a second linkage means interconnecting said motor means and said drive gear means, the teeth of which are adapted to engage corresponding teeth of the first gear means, and screen gear means connected with each hollow screen, the teeth of the screen gear means being adapted to engage corresponding teeth of the first gear means.

The variable speed device may be employed to control either the rotation of the hollow screen or the rotation of the rotary drum in order to permit synchronization of the velocity of the two rotating members by increasing or decreasing the speed of rotation of one relative to the other. However, in a preferred embodiment, the variable speed device is employed to control the rotation of the hollow screen and preferably is interposed between the motor means associated therewith and the afore-mentioned drive gear means. Furthermore, it is preferred that the same motor means be employed to drive both rotating members.

DETAILED DESCRIPTION OF THE DRAWINGS

Figure 1:
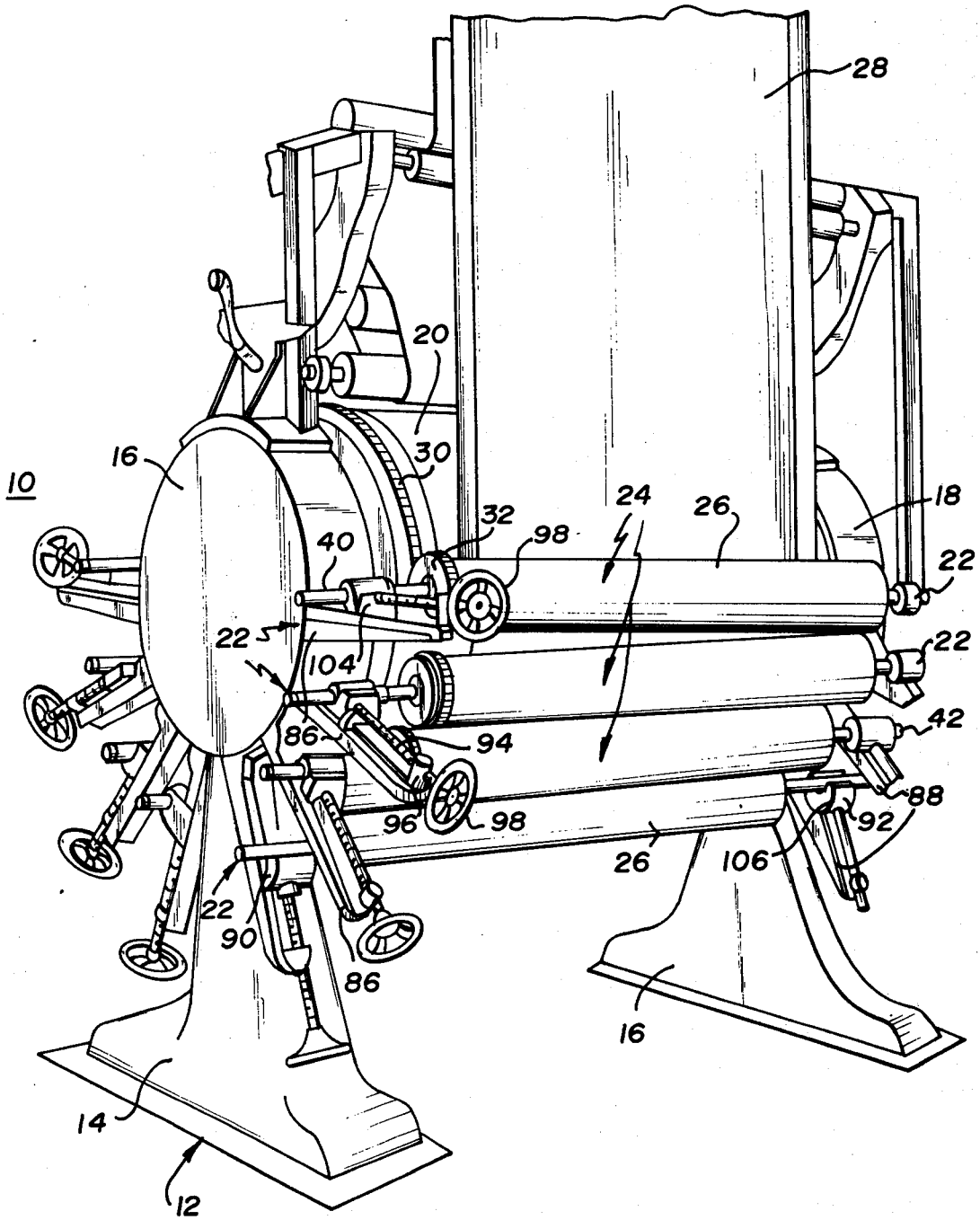
FIG. 1 is a perspective view of a screen printing machine constructed in accordance with the teachings of the invention.

Turning to the Figures, there is shown in FIG. 1 a screen printing machine broadly designated 10. The machine 10 includes a frame 12 having side legs 14 and 16 which are provided at their respective upper ends thereof with circular end blocks 16 and 18 respectively. Journaled for rotation between the end blocks 16 and 18 is backing drum 20. Supported circumferentially about the drum 20 by support arrangements broadly designated 22 which project out from the respective circular end blocks 16 and 18 are a plurality of identical rotary screen assemblies 24. The construction of the rotary assemblies 24 will be presented in further detail, but sufficient for present understanding, it is well known that such rotary screen assemblies incude a hollow screen 26 having finely apertured patterns through which ink or coloring paste is forced by an internal squeegee arrangement so as to print corresponding patterns on the material 28 passing between the backing drum 20 and the rotary screen assemblies 24. In this connection, first gear means in the form of a large gear 30 is freely mounted for rotation on the same shaft (see FIG. 2) upon which the back-up drum 20 rotates, said gear 30 being free to rotate independently of the drum 20. The teeth of gear 30 engage corresponding teeth on screen gears 32 associated with each rotary assembly 24, whereby rotation of the gear 30 causes corresponding rotation of said screen gear 32 (but in opposite direction) and thus rotation of the screen 26. A detailed description of the operations of these elements will be set out hereinafter in the discussion of FIG. 2.

It will be appreciated from the above discussion that the invention hereof is being illustrated in the environment of a rotary screen printing machine, that is one which includes the large rotating back-up drum 20 about which are circumferentially spaced the rotary screen drum assemblies 24. Such a printing machine is described in detail in copending application Ser. No. 326,396 filed Jan. 24, 1973 (assigned to the assignee of the present invention), now abandoned and continuation-in-part Ser. No. 537,649 filed Dec. 31. 1974, now U.S. Pat. No. 3,934,502, the disclosure of which is incorporated herein by reference thereto. However, the invention hereof is not to be deemed limited to such environment since as it will become apparent, the principles hereof will be applicable to a conventional flat bed screen printing machine in which the plurality of rotary screen assemblies are located in the same plane and each is provided with an individually associated back up roller.

As seen in copending application Ser. No. 326,396, each rotary screen assembly 24 includes an inner elongated support member provided at each end with a support block. Extending from opposite ends of the inner elongated support member are first and second hollow shaft members 40 and 42, respectively, shown in FIGS. 1 and 2 hereof. The hollow screen 26 is freely rotatably supported with respect to the inner elongated support member by being telescopically carried by a pair of circular end plates 48 which are freely rotatable with respect to the associated shaft member 40 (or 42 at the other end) with the aid of ball bearings (not shown).

The inner elongated support member supports an elongated applicator which is a conventional squeegee the edge of which engages the inner surface of the screen 26 to force ink through the patterned regions provided therethrough. A complete description of the squeegee and its associated components is disclosed in copending application Ser. No. 326,396.

As is well known, the orientation is such that the point of engagement of the squeegee with respect to the inner surface of the screen 26 is on the radius of the back-up drum 20. In other words, the squeegee lies perpendicular to the flow path of the fabric 28 passing between the screen 26 and the back-up roller 20.

Referring to FIG. 1, it is seen that for each rotary screen assembly 24, the frame includes a pair of outstanding projections 86 and 88, respectively. Slidably mounted on the projections 86 and 88 are carriages or saddles 90 and 92, respectively, which include forwardly extending screw threaded portions 94 which engage internally threaded passageways provided in outstanding studs 96 provided on the projections 86 and 88, respectively. On the screw threaded portions 94 are hand wheels 98 which may be rotated to cause the carriages 90 and 92 to travel inwardly or outwardly on the projections 86 and 88 with respect to the back-up drum 20.

Figure 2:
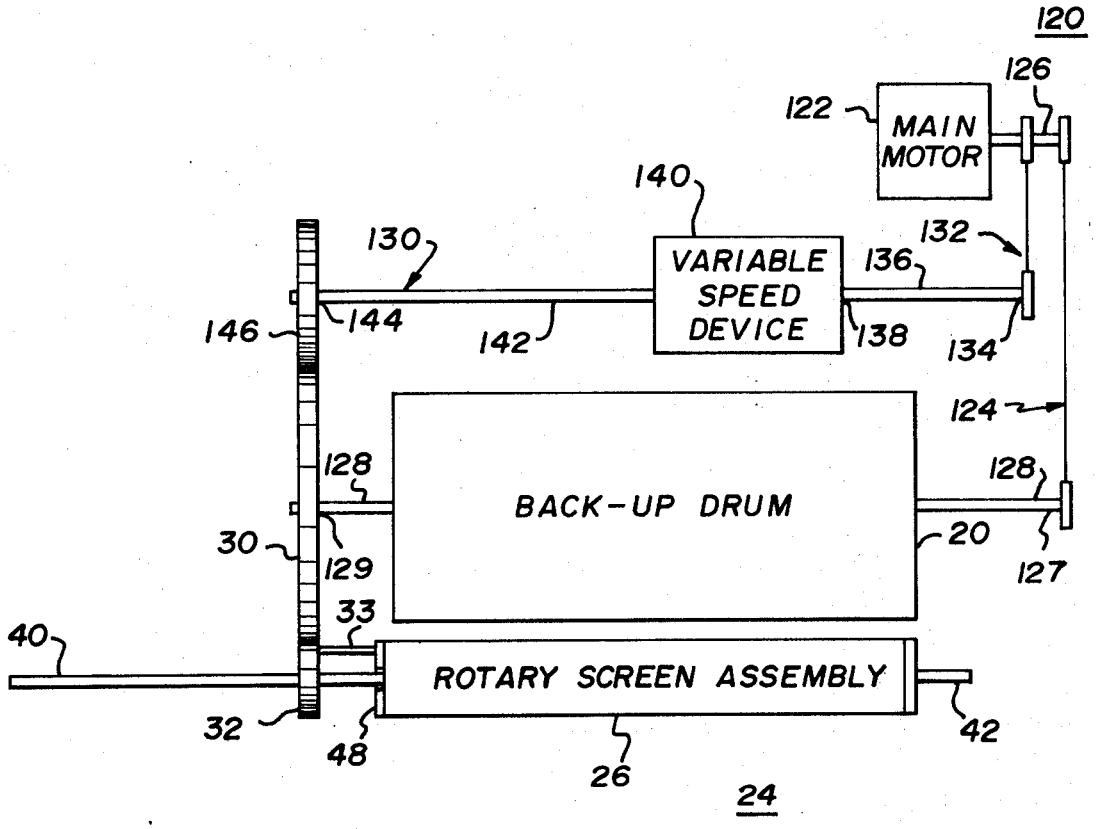
FIG. 2 is schematic illustration of the apparatus in accordance with the present invention as shown in FIG. 1 including drive means for operating such apparatus.

In accordance with the present invention, the back-up drum 20 and the screen 26 of the rotary screen assemblies 24 are preferably independently driven by means such as schematically shown in FIG. 2. FIG. 2 illustrates one rotary screen assembly 24. However, it will be appreciated that a typical rotary screen printing machine will include a plurality of such rotary screen assemblies positioned about back-up drum 20, each of said assemblies having a screen gear 32 at one end thereof in engagement with large sun gear 30 (as shown in FIG. ). Each screen 26 is linked to its respective screen gear 32 for rotation therewith as disclosed, for example, in the copending application Ser. No. 326,396; this can be preferably accomplished employing one or more linking pins 33 joining the screen gear 32 and the end plate 48.

First drive means indicated generally by the numeral 120 are operatively connected to the back-up drum 20 for rotating the back-up drum independently of the screen 26 of the rotary screen assembly. The first drive means 120 include a first linkage means such as a conventional pulley system indicated generally by the numeral 124 which interconnects output shaft 126 of motor means or drive mechanism 122 to one end 127 of the shaft 128 upon which back-up drum 20 is fixedly secured. The first and second drive means are driven by motor 122.

The second drive means, indicated generally by the numeral 130, is operatively connected to the rotatable screen 26 of the rotary screen assembly 24 for rotating screen 26 independently of rotation of the back-up drum 20. The second drive means 130 includes large gear or sun gear means 30 which is rotatably mounted on the end 129 of shaft 128, in a manner such that it floats freely thereon and is rotatable independently of the back-up drum 20. The output shaft 126 of motor means 122 is linked through second linkage means such as a conventional pulley arrangement 132, to one end 134 of a driven shaft 136; the opposite end 138 is linked to a variable speed device 140 (which does not comprise a portion of the second drive means) which will be described in greater detail hereinafter. The output of the variable speed device 140 is a rotating shaft 142 on the other end 144 of which drive gear 146 is fixedly secured. The teeth of the drive gear 146 engages corresponding teeth of the sun gear 30.

Screen gear 32 is connected with the screen 26 of the rotary screen assembly 24 as indicated, in a manner such that the teeth of the screen gear 32 engages corresponding teeth of the gear 30. Thus, rotation of output shaft 142 causes rotation of drive gear 146, which in turn causes rotation of large gear 30, which causes corresponding rotation of screen gear 32 and thus rotation of screen 26.

The variable speed device 140 is employed to control the speed of the rotation of drive gear 146 and thus the speed of rotation of large gear or sun gear 30 and screen gear 32 in order to synchronize the linear velocity of the screen 26 of rotary screen assembly 24 with the linear velocity of the back-up drum 20.

In operation of the apparatus shown in FIGS. 1 and 2, the motor means 122 is activated thereby causing rotation of output shaft 126 which in turn causes rotation of back-up drum 20. Furthermore, rotation of output shaft 126 causes rotation of drive shaft 136. Activation of variable speed device 140 causes controlled rotation of rotating shaft 142 thereby causing rotation of drive gear 146, rotation of large gear 30 and thus rotation of screen gear 32 and consequently rotation of screen 26. Thus, the variable speed device 140 is employed to vary or control the speed of rotation of shaft 142 relative to the speed of rotation of shaft 128, thereby permitting one to vary or control rotation of screen 26 relative to the speed of rotation of back-up drum 20.

The variable speed device can comprise any conventional device which will enable one to control the speed of rotation of shaft 142. Examples of such variable speed device include mechanical differential draw transmissions such as marketed under the name Specon (registered trademark) by Fairchild Industrial Products Division, variable speed transmissions such as marketed under the name Vari-Chain (registered trademark) by Fairchild Industrial Products Division, and variable speed drives marketed by Link-Belt under the name differential P. I. V. drives. Variable speed devices such as marketed by Reeves may also be employed. A preferred variable speed device for use herein comprises a variable speed transmission such as the Vari-Chain device marketed by Fairchild Industrial Product Division.

The output shaft 126 and shafts 128 and 136 are preferably driven by the same motor means 122 so that the back-up drum 20 and the drive gear 146, large gear 30, screen gear 32 and screen 26 of said rotary screen assembly 24 can be driven at similar speeds. However, if desired, separate motor means may be employed to drive shaft 136 and shaft 128 in which case the variable speed device could be a speed control device directly controlling either of such motors.

Furthermore, it will be apparent that the variable speed device may be employed to control the speed of rotation of the back-up drum 20.

What is claimed is:

1. A screen printing machine comprising:

a frame;

a rotary drum supported by said frame and mounted on a shaft having first and second shaft portions extending from opposite ends of said drum;

a plurality of rotary screen assemblies carried by said frame and distributed circumferentially about said rotary drum, each of said assemblies including a rotatable screen;

a single drive mechanism and a first drive means connected to said single drive mechanism for driving said rotary drum independently of driving said rotatable screens;

second drive means driven by said single drive mechanism and operatively connected to said rotatable screens for driving said rotatable screens independently of said rotary drum and simultaneously with said first drive means driving said rotary drum;

variable speed means operatively connected to one of said drive means for continuously synchronizing the velocity of said rotatable screens relative to the velocity of said rotary drum;

said second drive means including a sun gear freely rotatably mounted on said first shaft portion of said rotary drum, a drive gear, second linkage means interconnecting said single drive mechanism and said drive gear, the teeth of said drive gear engaging corresponding teeth of said sun gear, and a screen gear connected to each of said rotatable screens, the teeth of said screen gears engaging corresponding teeth of said sun gear.

2. The screen printing machine of claim 1 wherein each of said rotary screen assemblies includes first and second end shaft members, said first and second end shaft members extending from opposite ends of each of said rotatable screens to locations outside of said rotatable screen, each of said screen gears being carried by a respective one of said first end shaft members.

3. The screen printing machine in accordance with claim 1, wherein said first drive means is a first linkage means interconnecting said single drive mechanism and said rotary drum.

4. The screen printing machine in accordance with claim 1, wherein said variable speed means is interposed in said second linkage means between said single drive mechanism and said drive gear.

* * * * *

UNITED STATES PATENT OFFICE

CERTIFICATE OF CORRECTION

Patent No. 3,978,787 Dated September 7, 1976

Inventor(s) THOMAS MARINO, JOHN KREEFT, PETER STANISLAW

It is certified that error appears in the above-identified patent and that said Letters Patent are hereby corrected as shown below:

Column 4, Line 26, after "FIG." insert: -- 1 -- .

Signed and Sealed this

Sixteenth Day of November 1976

[SEAL]

*Attest:*

RUTH C. MASON
*Attesting Officer*

C. MARSHALL DANN
*Commissioner of Patents and Trademarks*